US009976312B2

(12) United States Patent
Boschian

(10) Patent No.: US 9,976,312 B2
(45) Date of Patent: May 22, 2018

(54) DEVICE FOR ATTACHING COVERING ELEMENTS TO A FLOOR BATTEN

(71) Applicant: Louis Boschian, Biot (FR)

(72) Inventor: Louis Boschian, Biot (FR)

( * ) Notice: Subject to any disclaimer, the term of this patent is extended or adjusted under 35 U.S.C. 154(b) by 0 days. days.

(21) Appl. No.: 15/300,136

(22) PCT Filed: Mar. 25, 2015

(86) PCT No.: PCT/EP2015/056339
§ 371 (c)(1),
(2) Date: Sep. 28, 2016

(87) PCT Pub. No.: WO2015/144742
PCT Pub. Date: Oct. 1, 2015

(65) Prior Publication Data

US 2017/0138063 A1 May 18, 2017

(30) Foreign Application Priority Data

Mar. 28, 2014 (FR) ..... 14 52737

(51) Int. Cl.
*E04F 15/02* (2006.01)
*E04B 1/00* (2006.01)

(52) U.S. Cl.
CPC ..... *E04F 15/02044* (2013.01); *E04B 1/003* (2013.01); *E04F 15/02183* (2013.01); *E04F 2015/02122* (2013.01)

(58) Field of Classification Search
CPC ..... E04F 13/0803; E04F 15/02044; E04F 15/02183; E04F 2015/0205;
(Continued)

(56) References Cited

U.S. PATENT DOCUMENTS 4,095,385 A * 6/1978 Brugman ..... E04B 9/247 52/506.08
5,027,573 A * 7/1991 Commins ..... E04B 1/2608 52/480
(Continued)

FOREIGN PATENT DOCUMENTS

EP 2 084 340 8/2009
ES 2 448 190 3/2014
(Continued)

OTHER PUBLICATIONS

International Search Report for corresponding International PCT application No. PCT/EP2015/056339, dated May 28, 2015.

*Primary Examiner* — Rodney Mintz
(74) *Attorney, Agent, or Firm* — Hauptman Ham, LLP

(57) ABSTRACT

The invention relates to a device for fixing, to a top face of a floor batten, cladding elements each having at least one edge provided with a groove, said device comprising at least one body configured so as to be fixed to the floor batten and a clamp having a rod intended to cooperate with said body and with a head, the head being configured so as to cooperate with at least one groove in at least one cladding element in order to provide the locking of said cladding element, characterized in that the fixing device comprises at least one holder intended to be at least partly inserted in the body and in a side of the floor batten so as to fix the body on the side of the floor batten and so that a traction or compression applied to said head exerts a shear force at the holder.

15 Claims, 4 Drawing Sheets

(58) Field of Classification Search
CPC .. E04F 2015/02094; E04F 2015/02122; E04F 15/04; E04F 2201/05; E04F 2201/0115; E04F 2201/023; E04B 1/003; E01C 5/22
USPC ..... 52/586.1, 586.2, 585.1, 650.3
See application file for complete search history.

(56) References Cited

U.S. PATENT DOCUMENTS

| | | | | |
|---|---|---|---|---|
| 5,997,209 | A * | 12/1999 | Sachs | E04B 5/12 403/384 |
| 6,502,362 | B1 * | 1/2003 | Zambelli | E04B 1/41 52/357 |
| 7,913,960 | B1 * | 3/2011 | Herr, III | E04F 11/181 16/221 |
| 8,167,275 | B1 * | 5/2012 | Bizzarri | E04F 11/181 256/65.02 |
| 8,806,829 | B2 * | 8/2014 | Pelc | E04F 15/02 403/408.1 |
| 9,181,715 | B2 * | 11/2015 | Orchard | E04F 15/02044 |
| 9,422,728 | B2 * | 8/2016 | Gamble | E04F 15/02044 |
| 9,822,809 | B2 * | 11/2017 | Shadwell | E04F 15/02044 |
| 2003/0154662 | A1 * | 8/2003 | Bruchu | E04F 15/10 52/87 |
| 2003/0221391 | A1 * | 12/2003 | Bolton | B25B 23/00 52/741.1 |
| 2005/0257473 | A1 * | 11/2005 | Shaw | E04F 15/02 52/480 |
| 2008/0222993 | A1 * | 9/2008 | Prichard | E04F 15/02005 52/702 |
| 2010/0257806 | A1 * | 10/2010 | Snell | E01C 5/005 52/483.1 |
| 2011/0192112 | A1 * | 8/2011 | Pelc, Jr. | E04F 15/02 52/705 |
| 2013/0025230 | A1 * | 1/2013 | Turner | E04F 15/02044 52/586.1 |
| 2013/0104493 | A1 * | 5/2013 | Orchard | E04F 15/02044 52/704 |
| 2013/0247504 | A1 * | 9/2013 | Pelc | E04F 15/02 52/704 |
| 2014/0096469 | A1 * | 4/2014 | Fountain | E04F 15/02044 52/650.3 |
| 2014/0318065 | A1 * | 10/2014 | Torres-Pinzon | E04F 15/02044 52/403.1 |
| 2014/0366334 | A1 * | 12/2014 | Gamble | E04F 15/02044 24/305 |
| 2015/0252572 | A1 * | 9/2015 | Bauer | E04F 13/0835 403/348 |
| 2015/0275951 | A1 * | 10/2015 | Shadwell | E04F 15/02044 411/511 |
| 2016/0362902 | A1 * | 12/2016 | Lee | E04F 15/02161 |
| 2017/0037643 | A1 * | 2/2017 | Mitchell | E04F 15/02044 |
| 2017/0044776 | A1 * | 2/2017 | Rodriguez Lopez | E04F 13/0826 |
| 2017/0314278 | A1 * | 11/2017 | Lee | E04G 23/0285 |

FOREIGN PATENT DOCUMENTS

| | | | | |
|---|---|---|---|---|
| FR | 2 960 248 | | 11/2011 | |
| GB | 2543945 | A * | 5/2017 | |
| WO | 2008052236 | | 5/2008 | |
| WO | WO 2013162451 | A1 * | 10/2013 | E04B 1/003 |

* cited by examiner

DEVICE FOR ATTACHING COVERING ELEMENTS TO A FLOOR BATTEN

FIELD OF THE INVENTION

The present invention relates to a device for fixing a cladding element on a floor batten.

The invention will find an application for mounting and fixing any type of cladding element such as boards to form a floor.

TECHNOLOGICAL BACKGROUND

In the field of floors, more particularly for terraces, the mounting is done from one end of the surface to be covered as far as the other by fixing, as you go along, a floor board, a link and then another floor board. Link means a piece fixed to the floor and cooperating with the adjacent two boards in order to hold them fixed.

This type of device has several drawbacks, including the fixing of said link directly to the top face of a floor batten or of a timber strip, causing pull-away work. This pull-away work prematurely damages the fixing device in question owing to the repeated compression and/or attraction forces exerted on the link.

Other devices make provision for positioning two fixing devices over the width of the same floor batten, when two boards are joined. This therefore requires providing a floor-batten width at least twice the width of a fixing device. This may also have the drawback of having to put two floor battens against each other in order to be able to position two fixing devices alongside each other.

Fixing devices are also known comprising a clip having lateral flanges able to be engaged in grooves in boards and a screw passing through the clip in order to screw onto the top face of a floor batten. After the installation of the cladding elements, these clips no longer make it possible to access the screw and make dismantling impossible or makes it necessary to rework the whole of the structure as from the last board placed.

The use of this clip does however limit to a clearly determined choice of floor boards, the assembly grooves of which, intended for inserting said clip, have a profile suited to the cross-section of the flanges of the latter and precisely determine the height of the groove on the edge of the board.

In some versions the specific form of the grooves also has the drawback of having necessarily to mount boards in a specific direction, without any possibility of reversibility of the boards.

This clip also has the drawback, when it is positioned between the boards, of deforming and coming to bear on its heel at the top face of the floor batten. This "heeling" effect gives rise to a significant risk of loss of elasticity of the clip over time and causes a lack of pressure force and therefore of holding of the cladding elements.

There therefore exists the need to propose a fixing device for a cladding element that is sufficiently robust not to undergo deformation over time and cooperating with any type of cladding element, comprising grooves on the edge.

SUMMARY OF THE INVENTION

The present invention makes it possible to solve all or at least some of the drawbacks of the known solutions by proposing a fixing device the design of which allows fixing by mechanical clamping and shearing work while adapting to any type of cladding element. The invention also makes it possible to use two narrow floor battens, without requiring placing them against each other when two boards are jointed.

More precisely, the invention relates to a device for fixing, to a top face of a floor batten, cladding elements each having at least one edge provided with a groove, said device comprising at least one body configured so as to be fixed to the floor batten (and a clamp, having a rod intended to cooperate with said body and with a head, the head being configured so as to cooperate with at least one groove in at least one cladding element in order to provide the locking of said cladding element. The fixing device comprises at least one holder intended to be at least partly inserted in the body and in a side of the floor batten so as to fix the body on the side of the floor batten and so that a traction or compression applied to said head exerts a shear force at the holder.

One technical effect produced by the present invention is greatly resisting pulling away. In a particularly advantageous fashion, the invention allows shearing work rather than pulling away, which increases the force for holding the cladding elements and the strength of the device.

Another advantage of the invention is that the fixing device can be stressed after the structure is produced so as to increase the fixing forces of the cladding element without dimensional limit.

The invention also relates to an assembly comprising at least one fixing device, at least one cladding element and at least one floor batten; the cladding element being held fixed to the floor batten by at least one fixing device according to the present invention.

The invention moreover proposes a method for fixing at least one first cladding element to a floor batten by means of a fixing device according to the present invention. The method comprises at least:

- a step of fixing at least one fixing device to a side of the floor batten;
- a step of positioning the first cladding element opposite a top face of the floor batten, said top face extending perpendicular to the side of said floor batten, until partial introduction of the head of the fixing device in a groove in the first cladding element;
- a step of screwing the clamp in order to lock said first cladding element on the top face of the floor batten.

Advantageously, the fixing method according to the present invention is relatively simple and accessible for any type of user. Furthermore it does not require any constraint relating to the positioning of said device on a side of the floor batten.

BRIEF INTRODUCTION OF THE FIGURES

Other features, aims and advantageous of the present invention will emerge from a reading of the following detailed description with regard to the accompanying drawings given by way of non-limitative examples, and on which:

Figure 1A:
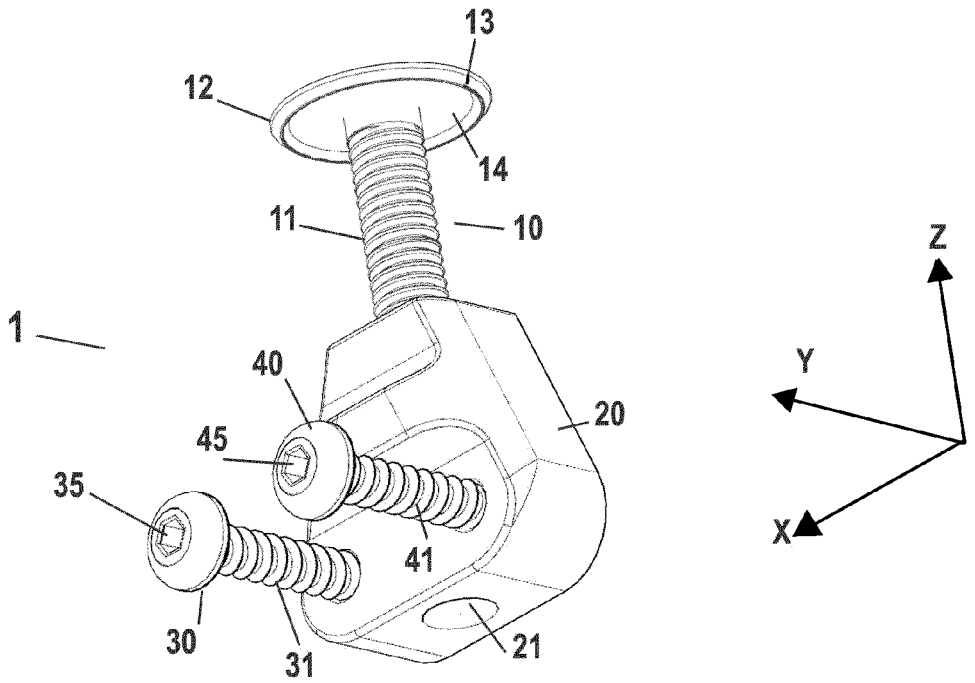
FIGS. 1A and 1B illustrate three-dimensional views of the fixing device according to the invention.

The drawings are given by way of examples and are not limitative of the invention. They constitute schematic outline representations intended to facilitate understanding of the invention and are not necessarily to the scale of practical applications. In particular, the relative dimensions of the various elements do not represent reality.

By way of indication, a three-dimensional orthonormed reference frame comprising three unitary axes (x, y, z) that are orthogonal in pairs is indicated on some figures in order to facilitate understanding thereof.

DETAILED DESCRIPTION

Before beginning a detailed review of embodiments of the invention, optional features, which may optionally be used in association or alternatively, are stated below:

The body comprises at least one longitudinal opening intended to receive the clamp. Advantageously, the clamp does not cooperate with the top of the floor batten so as to minimise pulling-away work of said clamp.

The body comprises a first face configured so as to bear on said side of the floor batten. Particularly advantageously, this fixing of the body on the side of the floor batten promotes a shearing force.

The body preferably comprises at least one transverse opening, extending perpendicular to the axis of revolution of the longitudinal opening and from the first face as far as the second face of the body, opposite to the first face. Advantageously, this opening has a holder passed through it and will enable said means to hold the body on the side of the floor batten.

The fixing device comprises at least one holder able to cooperate with said transverse opening. This holder advantageously makes it possible to hold the fixing device on the side of the floor batten.

Preferentially the holder comprise a rod intended to enter the floor batten and extending in a direction perpendicular to the direction in which the rod carrying the head of the clamp extends.

Preferentially, the head intended to cooperate with a groove carried by the cladding element extends mainly in one plane. At least one holder comprises a rod intended to enter the floor batten and which extends in a direction perpendicular to said plane of the head.

Preferentially, the holder comprises a rod able to pass at least partially through the thickness of the floor batten so as to hold the body on the side of the floor batten.

The device comprises a first spacing or first distance L between a first holder and the axis of the longitudinal opening and a second spacing or second distance I between a second holder and the axis of the longitudinal opening; the difference between said first and second spacings or distances (L-I) being at least equal to the diameter of the rod of said holder. Particularly advantageously, the holders are disposed asymmetrically in relation to the axis of the longitudinal opening. This advantageously prevents the holder of a first fixing device from coming into abutment with the holder of a second fixing device; said first and second fixing device each being positioned on facing parallel sides of the same floor batten.

The holder comprises, at one end of the rod, a head comprising a housing able to receive a driving tool. This facilitates the fitting of the fixing device on the sides of the floor batten.

The clamp comprises a relief on the bottom face of the head. Advantageously, the relief makes it possible to increase the friction forces with the groove of the cladding element. Particularly, the relief formed on the clamp makes it possible to increase puncturing and promotes anchoring of the cladding element.

Advantageously, the head of the clamp comprises a housing able to receive a driving tool.

The body and at least the clamp are preferentially pre-assembled. According to a preferred embodiment, the holders are also pre-assembled on the body. This pre-assembling advantageously facilitates and simplifies the fitting of the fixing devices on the floor battens or strips. Particularly advantageously, the user will not himself have to have recourse to a step of assembling the various parts forming the fixing device.

Preferentially, the body comprises a first face configured so as to bear on said side of the floor batten. Advantageously, the first face of the body comprises at least one attachment means forming a projection. Particularly advantageously, the attachment means provides better holding of the body on the side of the floor batten. This attachment means forms, for example, a stop, that is to say a relief, on the first face of the body, advantageously making it possible to increase the friction forces between the body and the side of the floor batten, thereby assisting holding of the body.

According to one embodiment, in an assembly comprising at least first and second cladding elements, the rod of the fixing device clamp is configured so that its diameter represents a minimum spacing separating the first and second cladding elements, in positioning. Advantageously, the rod serves as a stop for the cladding elements.

According to a preferential embodiment, prior to the screwing step, the method comprises a step of positioning a second cladding element until partial introduction of the head of the device in the groove in said cladding element.

According to a preferred embodiment, the step of positioning the first cladding element is performed until the cladding element comes to abut against the rod of the clamp.

Preferentially, the fixing step comprises the translational driving of the holders by means of a driving tool so as to at least partially pass through the thickness of the floor batten. The holders may also be referred to as holding elements.

In the following description, and in a preferred manner, the fixing device according to the invention is intended for fixing an element preferably for cladding timber boards for terrace floors.

The fixing device according to the invention is able to cooperate with grooves formed on the edge of cladding elements. The cladding elements may be parts with various shapes, preferentially flat and elongate, such as panels, slats or boards. The cladding elements may for example be made from wood, metal or plastics material.

In the following description, floor batten means any element having a face on which cladding elements are intended to bear. For example, and non-limitatively, the terms floor battened, strip, beam or bar are interchangeable in the present patent application and the invention applies to each of these terms and synonyms thereof.

In the following description the invention "means for" may be replaced by the expression "element for".

Figure 1B:
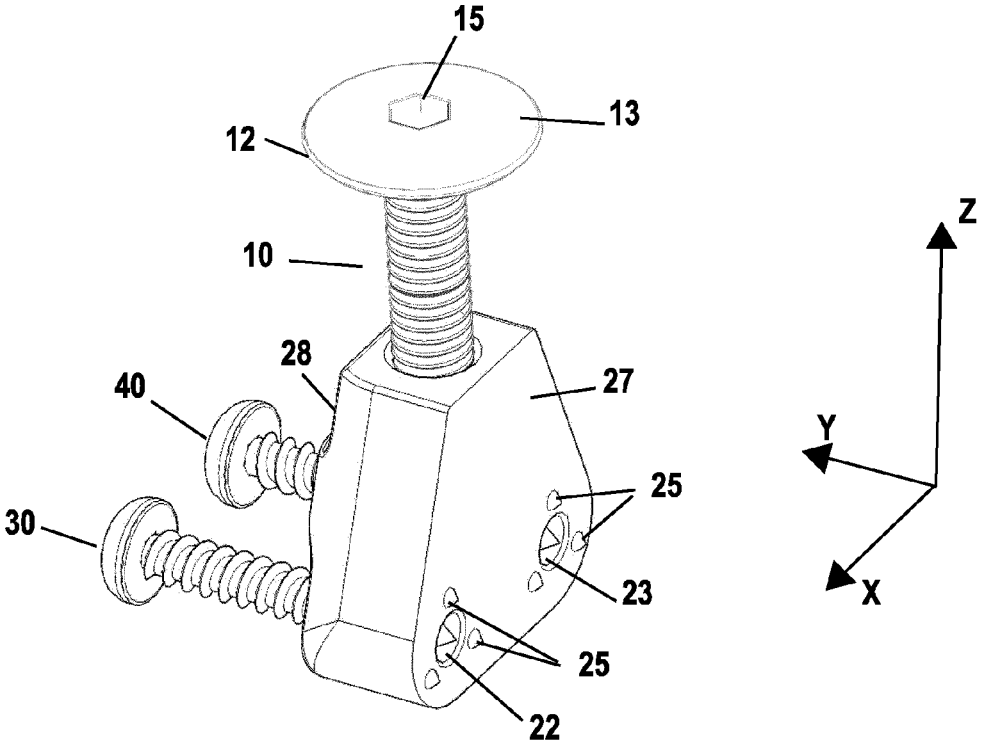

FIGS. 1*a* and 1*b* illustrate a three-dimensional view of the fixing device 1 in a non-limitative example configuration of the invention. The fixing device 1 comprises a body 20, a clamp 10 also referred to as fastner or clamping means and at least two holders 30, 40 also referred to as holding means.

The body 20 is in a single piece, preferably monolithic. It may be produced from various materials, preferentially metal or metal alloy or bent metal sheet. It may also be made from plastics material or resin.

The body 20 is advantageously in the form of prism, preferably triangular. The body 20 has a height in a direction z, preferably of between 20 and 40 millimeters. The body 20 has a thickness in a direction y, parallel to the direction z, preferably of between 5 and 20 millimeters.

Advantageously, the body 20 comprises at least one longitudinal opening 21 intended to receive a clamp 10 according to the invention, so as to hold the at least one cladding element on a floor batten. The longitudinal opening 21 is preferentially a cylindrically shaped through hole. The axis of revolution of the longitudinal opening 21 extends along the height of the body 20, that is to say in the direction z. Axis of revolution means the straight line passing through the centres of the bases of said opening 21; said opening preferably being cylindrical.

The clamp 10 is preferably made from stainless steel. The clamp 10 comprises a rod 11, preferably cylindrical, and threaded. The thread is preferentially helical. This rod 11 is able to cooperate with the body 20 and more precisely with said first longitudinal opening 21 passing through the body 20.

This rod 11 cooperates at one of its ends with a head 12 that is preferentially cylindrical. According to a preferred embodiment, the head 12 is constrained to move with the threaded rod 11 in a translation movement of said rod 11. According to another embodiment, the head 12 has a free rotation movement around the threaded rod 11, while keeping cooperation with the rod 11 in a translation movement. The head 12 can there for example take the form of a perforated plate or a washer allowing rotation of said threaded rod 11. The head 12 may be in a square, round or oblong shape for example. This head 12 is intended to be inserted in a groove in a first cladding element; said element being fixed to the top face of a floor batten.

The top face 13 of the head 12 is a circular face, preferably planar, provided with a housing 15 for receiving for example a tool 5 for driving the clamp 10 in rotation and translation. According to a preferential embodiment, the housing 15 is formed by a hexagonal cavity of the "Torx" type able to receive a driving tool 5, for example an Allen key.

The body 20 comprises a first face 27 intended to bear on a side of a floor batten. The body 20 comprises at least one transverse opening 22, 23. The at least one transverse opening extends perpendicular to the longitudinal opening 21 and from the first face 27 as far as a second face 28 of the body 20; said second face 28 being opposite to the first face 27. Preferably, the body 20 comprises at least one and preferably two transverse openings 22, 23. The transverse openings 22, 23 are each preferentially in the form of a cylindrically-shaped through hole. They extend across the thickness of the body 20, that is to say in the direction y. In position, the transverse openings 22, 23 extend perpendicular to the side of the floor batten; the side on which the body 20 is positioned.

The holders 30, 40 are preferentially made from stainless steel. The holder 30, 40 comprise a rod 31, 41, preferably cylindrical, and threaded. The thread is preferentially helical. According to a non-limitative example of the invention, the holders 30, 40 are screws. According to another embodiment, the holders 30, 40 are nails. The rods 31, 41 of the holders 30, 40 are able to cooperate with the body 20 and more precisely with the transverse openings 22, 23 in the body 20.

These rods 31, 41 are provided at one of the ends thereof with a head, preferentially cylindrical in shape. The top face of the head of the holders 30, 40 is a circular face, preferably planar. It is preferentially provided with a housing 35, 45 for receiving for example a tool 5 for rotating and translating said holder 30, 40. According to a preferential embodiment, the house 35, 45 is formed by a hexagonal cavity or of the "Torx" type able to receive a driving tool, for example an Allen key.

Preferentially, the body 20 comprises, on a first face intended to be opposite a side of the floor batten 50, at least one attachment means 25 forming a projection. This attachment means 25 forms for example a stop, that is to say a relief on the first face 27 of the body 20 advantageously making it possible to increase the friction forces between the body 20 and the floor batten, thereby assisting the holding of the body.

Figure 2A:
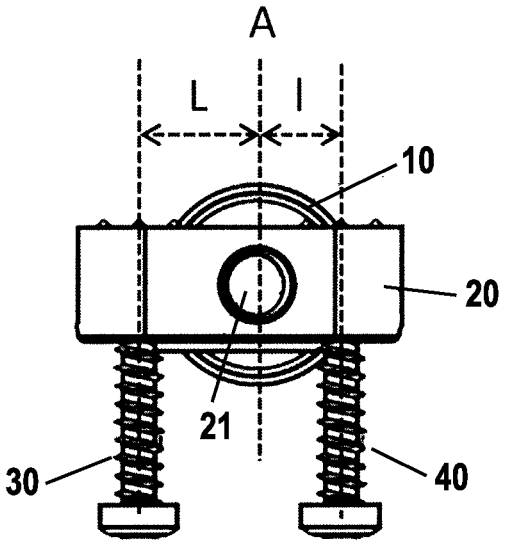
FIGS. 2A and 2B illustrate views of the fixing device, respectively from below, above and behind.
Figure 2B:
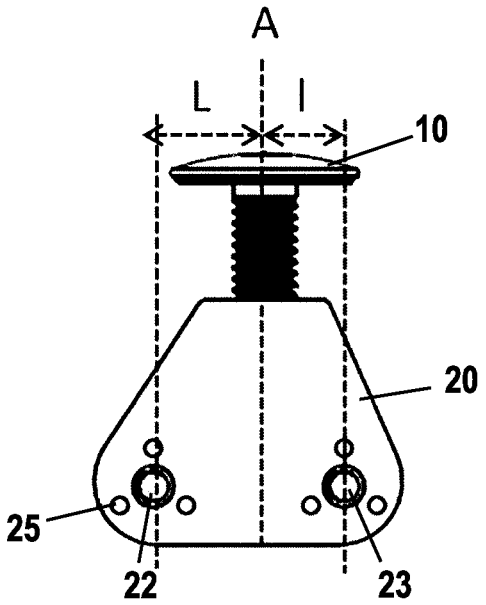

FIGS. 2*a* and 2*b* are views of the fixing device, respectively from below and behind. These figures illustrate a preferential embodiment of the embodiment having asymmetry of the holders 30, 40 with respect to the axis of revolution of the longitudinal opening 21.

In particular, the holders 30, 40, preferably disposed on either side of the longitudinal opening 21, are not positioned at equal distances from the axis of said longitudinal opening 21. A first spacing L can be considered, separating a first transverse opening 22 cooperating with a first holder 30 and the axis of the longitudinal opening 21 and a second spacing I separating a second transverse opening 23 cooperating with a second holder 40 and the axis of the longitudinal opening 21. According to a particularly advantageous embodiment, the difference between the first spacing L and the second spacing I is at least equal to the diameter of the rods 31, 41 of the holders 30, 40.

According to another embodiment where the device comprises only one holders 30 or 40 and thereby only one transverse opening 22, 23, it is advantageous to offset the positioning of the transverse opening 22, 23 with respect to the axis of the clamp 10 that serves as a strut, in order to give rise to asymmetry for combining the intersection of the holders 30, 40 without their coming into abutment when they are positioned on the opposite sides 51*a*, 51*b* of the same floor-batten portion 50.

Figure 3:
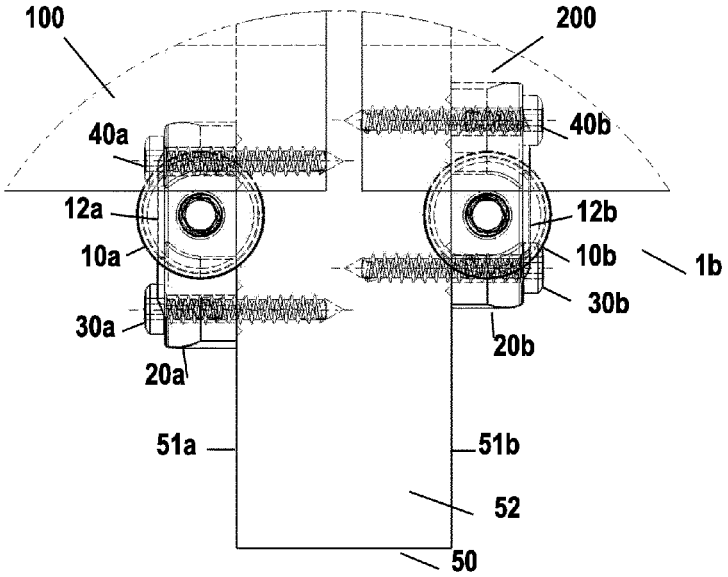
FIG. 3 illustrates a plan view of two fixing devices positioned on the sides of a floor batten.

FIG. 3 illustrates a plan view of two fixing devices 1*a*, 1*b* positioned on the sides of a floor batten 50. The floor batten 50 is preferably made from wood. The preferred embodiment according to which the holders 30, 40 are disposed asymmetrically in relation to the axis of the longitudinal opening 21 advantageously prevents the holders 30*a*, 40*a* of a first fixing device 1*a* from coming into abutment with the holders 30*b*, 40*b* of a second fixing device 1*b*; said first and second fixing devices 1*a*, 1*b* each being positioned on facing and parallel sides of the same floor batten 50. FIG. 3 shows the efficacy of the device and in particular in the case where the floor batten 50 is thin. The thickness of the floor batten 50 means the spacing between two facing and parallel sides 51 of said floor batten 50.

According to an embodiment requiring the fixing of a first cladding element 100 and a second cladding element 200 on the sides 51 of the same floor batten 50, a step of fixing a first device 1*a* on a first side 51*a* of the floor batten 50 is first of all performed, followed by a step of fixing a second device 1*b* on a second side 51*b* of the floor batten 50; the second side 51*b* being opposite and parallel to the first side 51*a*. To keep the alignment of the first and second cladding elements 100, 200, before they are fixed to the floor batten 50 by the fixing devices 1*a*, 1*b*, it is necessary for the head 12*a* of the first cladding means 10*a* of the first fixing device 1*a* to be aligned and in the same axis as the head 12*b* of the second clamp 10*b* of the second fixing device 1*b*. As illustrated in FIG. 3, the asymmetry of the holders 30*a*, 30*b*, 40*a*, 40*b* of the first and second fixing devices 1*a*, 1*b* allows an offset between said holders 30*a*, 40*a* of the first fixing device 1*a* and said holders 30*b*, 40*b* of the second fixing device 1*b* at least equal to the diameter of the rods 31, 41 of the holders 30*a*, 30*b*, 40*a*, 40*b*. This asymmetry is particularly advantageous since it avoids any problem of conflicts between holders 30*a*, 30*b*, 40*a*, 40*b* situated on opposite, facing and parallel sides 51*a*, 51*b* of the same floor batten 50.

Particularly advantageously, the invention avoids having recourse to the use of two floor battens 50 against each other for fixing two ends of cladding elements 100, 200.

Figure 4:
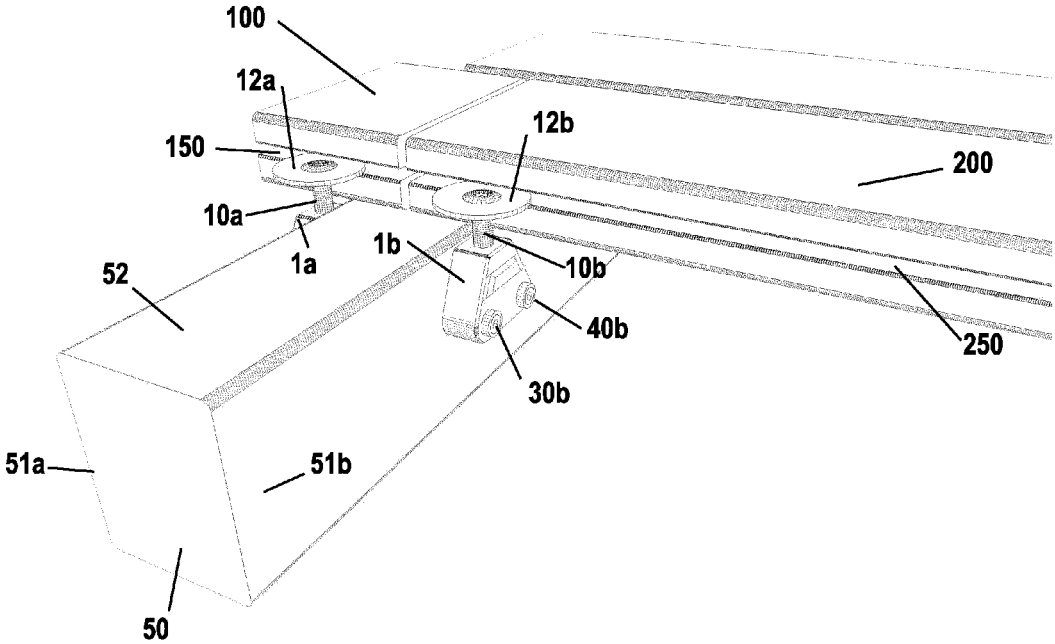
FIG. 4 illustrates a three-dimensional view of two fixing devices positioned on the sides of a floor batten. Each of these devices cooperates with a groove in a cladding element.

FIG. 4 illustrates a three-dimensional view of two fixing devices 1*a*, 1*b* positioned on either side of the edges 51*a*, 51*b* of a floor batten 50. Each of the devices 1*a*, 1*b* cooperates with a groove 150, 250 in a cladding element 100, 200. The first faces 27 of the bodies 20*a*, 20*b* of the fixing devices 1*a*, 1*b* are positioned facing one of the sides 51*a*, 51*b* of the floor batten 50.

The cladding element 100, 200 advantageously comprises a groove 150, 250 at its edge. The groove 150, 250 is formed by a top zone and a bottom zone. The top zone is sufficiently protruding to cover a portion of the head 12*a*, 12*b* of the clamping element 10*a*, 10*b*. Advantageously, the top zone and the bottom zone are symmetrical.

To allow effective cooperation between the clamp 10 and the at least one cladding element 100, 200, it is preferred for the thickness of the head 12*a*, 12*b* of the clamp 10*a*, 10*b* to be substantially equivalent to the width of the groove 150, 250, or even preferentially less. The head 12*a*, 12*b* of the clamp 10*a*, 10*b* is configured so as to be inserted in the groove 150 of a first cladding element 100 and to provide clamping of said element 100 on the floor batten 50, preferably a floor batten or a strip, during the rotation of the clamp by means of a tool.

According to one embodiment, the groove 150, 250 comprises a cavity, the shape of which cooperates with the head portion 12*a*, 12*b* of a clamp 10*a*, 10*b*. By way of example, for a head 12*a*, 12*b* in the form of a disc, the groove may be in the form of a half-disc, with a diameter at least greater than that of the head 12*a*, 12*b*. Advantageously, the invention makes it possible to use any type of cladding element, provided with a cavity intended to cooperate with the head 12*a*, 12*b* of the device according to the present invention.

The holders 30*b*, 40*b* may for example be driven in translation by a tool so as to at least partially pass through the thickness of the floor batten 50. Thickness means the spacing between a first side 51*a* of the floor batten 50 and a second side 51*b* of the floor batten 50, said sides 51*a*, 51*b* preferentially being opposite and parallel to each other.

Advantageously, the invention affords better mechanical holding of the fixing device 1*a*, 1*b* on the side of the floor batten 50.

Figure 5:
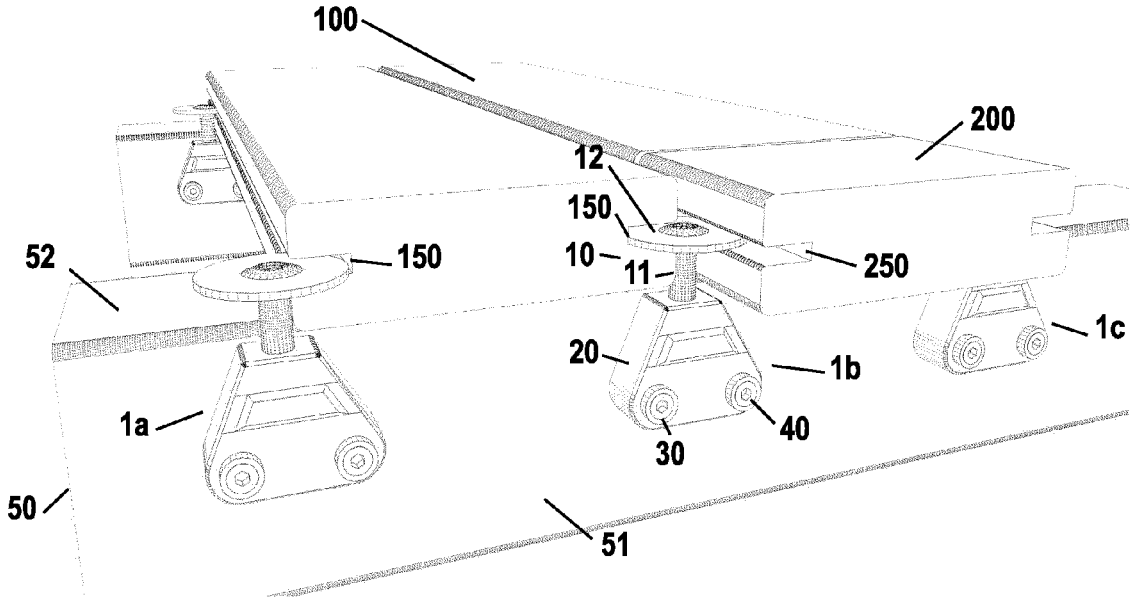
FIG. 5 illustrates a three-dimensional view of fixing devices positioned on sides of floor battens and holding the cladding elements disposed on said floor battens.

According to an embodiment depicted in FIG. 5, a plurality of fixing devices 1*a*, 1*b*, 1*c* are positioned on the same side 51 of a floor batten 50. The fixing devices 1*a*, 1*c* may fix only one cladding element 100 or fix two cladding elements 100, 200. Advantageously, a fixing device 1*a* according to the present invention, positioned on the side 51 of the floor batten 50, can hold a cladding element 100, 200 the end of which is positioned in line with the side 51 of said floor batten 50.

The method for mounting the device according to the invention is described below. According to a preferential embodiment, it is assumed, as shown in FIG. 5, that the floor batten 50 comprises a plurality of floor battens 50, positioned parallel and fixed for example to the ground. The first step is to position a fixing device 1*a* close to one o the ends of the floor batten 50 on one of the sides 51*a*, 51*b* of the floor batten 50. The operation is repeated on the adjacent floor battens 50, choosing at least one of the sides 51*a*, 51*b*. According to one embodiment, it is possible to choose to position the fixing devices 1*a*, 1*b* on two sides 51*a*, 51*b* of the same floor batten 50 so as to increase the fixing forces of the cladding elements 100 or to abut two cladding elements 100, 200. Next, perpendicularly on the top face 52 of the floor battens 50, the first cladding element is positioned against the clamp 10, so as to make the head 12 enter the groove 150 of the cladding element 100. The fixing device 1*a*, 1*b*, and in particular the body 20, is held on the side 51*a*, 51*b* of the floor batten 50 by the holders 30, 40, preferably screws.

Preferably, the fixing device 1*a*, 1*b* is positioned so that the head 12 of the clamp 10 cooperates with the groove 150 of the cladding element 100.

Successively, the user disposes a first cladding element 100 opposite a top face 52 of the floor batten 50, said top face extending perpendicular to the side 51 of said floor batten 50. The user disposes the first cladding element 100 so that a portion of the head 12 of the clamping element 10 is inserted in the groove 150 of the first cladding element 100.

The rod 11 of the clamping element 10 advantageously serves as a stop for the first clamping element 10. Optionally, it positions a second cladding element 200 so that another portion of the head 12 of the clamping element 10 is inserted in the groove 250 of said second cladding element 200. As before, the second cladding element 200 advantageously comes to abut against the rod 11 of the clamp 10. According to this preferential configuration, where first and second cladding elements 100, 200 are positioned on either side of the same clamp 10, the rod 11 serves as a stop for said cladding elements 100, 200. Particularly advantageously, the rod 11 makes it possible to create a spacing E between the two cladding elements 100, 200. Advantageously, this spacing E is at least equal to the diameter of the rod 11 of the clamp 10.

The spacing E between the cladding elements 100, 200 is preferentially of small size, around three to seven millimeters. This spacing E is necessary in order to be able to pass a tool intended to actuate the clamp 10. Advantageously, this spacing E between two cladding elements 100, 200 does not need to be of a width greater than the cross-section of the clamp 10 and in particular the diameter of the head 12 of said clamp 10. However, it is preferred for the housing 11 of the clamp 10 to have a cross-section less than that of the head 12 of said clamp 10 so as to be accessible at the spacing E between the cladding elements 100, 200.

When the fixing device is disposed between two cladding elements 100, 200, it is preferred for the head 12 of the clamp 10 to be disposed opposite the spacing E so that the housing 15 of the clamp 10 is accessible through the spacing.

Advantageously, the small thickness of the head 12 of the clamp 10 facilitates the introduction of said head 12 in the groove 150, 250 of the cladding elements 100, 200. When a part of the head 12 of a clamping element 10 is introduced into the groove 150 of a first cladding element 100, it is possible to position a second cladding element 200 parallel to the first cladding element 100 until a part of the head 12 of said clamp 10 is inserted in the groove 250 of said second cladding element 200.

Once the cladding elements 100, 200 have been positioned adjacent so as to preserve a spacing E advantageously at least equal to the diameter of the rod 11 of the clamp 10, the user can then lock said cladding elements 100, 200 by screwing of the clamp 10 through the spacing E formed between the cladding elements 100, 200. The clamp 10 is thus rotated by means of a tool (for example an Allen key), introduced into the housing 14, preferably hexagonal or of the "Torx" type, in the top face of the head 12. The screwing is carried out until the first and second cladding elements 100, 200 are held on the top face 52 of the floor batten 50.

The user repeats the previously described steps as many times as necessary to produce the whole of the surface to be covered by the cladding elements 100, 200.

Particularly advantageously, the removal of a cladding element 100, 200 does not require the removal of the clamp 10, nor that of the fixing device 1. This is because it suffices to slacken the clamp 10 so as to release the cladding element 100, 200 concerned.

According to a preferential but non-limitative embodiment of the invention, at least two fixing devices 1*a*, 1*b* are used on the same side 51 of a floor batten so as to ensure better holding of the cladding element 100, 200 on the top face 52 of the floor batten 50. This improves the holding of the cladding elements 100, 200, in particular when these elements have different lengths. A plurality of fixing devices 1*a*, 1*b* are thus used to fix the cladding elements 100, 200 over their entire length on the top face 52 of the floor batten 50.

Moreover, the fixing device 1 according to the invention advantageously makes it possible to retighten, without any dimensional limit, the cladding elements 100, 200, often subject to tangential shrinking. Tangential shrinking means the shrinking of the cladding element 100, 200 in the longitudinal direction. Particularly advantageously, such a shrinking will not have any impact and will be able to be corrected easily by virtue of the clamp 10 of the fixing device 1, which, compared with the known fixing device, is offset from the end of the cladding element. This is because, with the known fixing devices, if the cladding element shrinks, for example under the effect of a variation in temperature and/or if it is made from wood, the fixing device according to the prior art may no longer be in engagement with this cladding element. This risk is considerably reduced with the fixing device according to the invention.

The friction forces between the clamp 10 and the cladding element 100, 200 are sufficiently great not to create any clearance between the fixing device 1 and the cladding elements 100, 200. To increase the punching to promote the anchoring of the cladding element 100, 200, the clamp 100, 200 advantageously comprises, on the bottom face of the head 12, a relief increasing the friction. This relief is for example formed by grooves and/or stops. Thus, when the clamp 10 is rotated, the head 12 of said clamp 10 exerts an abutment force on the bottom zone of the groove 150, 250 locking the cladding element 100, 200 on the floor batten 50.

According to a preferred embodiment, two cladding elements 100, 200 supported by a single floor batten 50 are disposed, and advantageously only one fixing device 1 is positioned for holding the two cladding elements 100, 200 disposed on either side of the floor batten 50. In this non-limitative example depiction of the invention, the fixing device 1 may be positioned at the end of the floor batten 50.

The present invention is not limited to the embodiments previously described but extends to any embodiment covered by the claims. The fixing device according to the present invention may also be used for holding cladding elements intended for a vertical positioning of the wall cladding type. The pre-assembly of all the elements (body, clamp, holder) forming the fixing device facilitates the installation of such a cladding.

The invention claimed is:

1. A device for fixing, to a top face of a floor batten, one or more cladding elements each having at least one edge provided with a groove, said fixing device comprising:

at least one body configured to be fixed to the floor batten and a clamp having a rod configured to cooperate with said body and with a head, the head configured to cooperate with the groove of the at least one edge of at least one cladding element of the one or more cladding elements in order to lock said at least one cladding element, wherein the fixing device comprises at least one holder configured to be at least partly inserted in the body and in a side of the floor batten to fix the body on the side of the floor batten and so that a traction or compression applied to said head exerts a shear force at the holder, wherein the body comprises a first face configured to bear on said side of the floor batten, and the body further comprises at least one longitudinal opening extending through the body that receives the clamp.

2. The device according to claim 1, wherein the head of the clamp comprises a housing adapted to receive a driving tool.

3. The device according to claim 1, wherein the clamp comprises a relief on a bottom face of the head.

4. The device according to claim 1, wherein the first face of the body comprises at least one attachment forming a projection.

5. The device according to claim 1, wherein the body comprises at least one transverse opening, extending perpendicular to the longitudinal opening and from the first face as far as a second face of the body, opposite to the first face.

6. The device according to claim 5, comprising the at least one holder adapted to cooperate with the at least one transverse opening.

7. The device according to claim 6, wherein the at least one holder comprises an other rod intended to enter the floor batten and extending in a direction perpendicular to the direction wherein the other rod carrying the head of the clamp extends.

8. The device according to claim 7, comprising a first spacing between a first holder of the at least one holder and an axis of the longitudinal opening and a second spacing between a second holder of the at least one holder and the axis of the longitudinal opening; a difference between said first and second spacings being at least equal to a diameter of the other rod of the at least one holder.

9. The device according to claim 8, wherein the body and at least the clamp are pre-assembled.

10. An assembly comprising at least one fixing device, at least one cladding element and at least one floor batten; the cladding element being held fixed on the floor batten by said at least one fixing device according to claim 1.

11. The assembly according to claim 10, comprising at least one first and second cladding elements and wherein the rod of the clamp of the fixing device is configured so as a diameter of the rod represents a minimum spacing separating the first and second cladding elements, in positioning.

12. A method of fixing at least one first cladding element on a floor batten by the fixing device according to claim 1, comprising at least:

a step of fixing at least one said fixing device to the side of the floor batten;

a step of positioning the first cladding element (100) opposite the top face of the floor batten, said top face extending perpendicular to the side of said floor batten, until partial introduction of the head of the fixing device in the groove in the first cladding element;

a step of screwing the clamp in order to lock said first cladding element on the top face of the floor batten.

13. The method according to claim 12, wherein the step of positioning the first cladding element is performed until the cladding element abuts against the rod of the clamp.

14. The method according to claim 12, comprising, prior to the screwing step, a step of positioning a second cladding element until the head of the device is partially introduced in the groove in said second cladding element.

15. The method according to claim 12, wherein the fixing step comprises the driving translation of the holder by means of a driving tool so as to at least partially pass through a thickness of the floor batten.

* * * * *